US008556534B2

(12) United States Patent
Lim et al.

(10) Patent No.: US 8,556,534 B2
(45) Date of Patent: Oct. 15, 2013

(54) ATTACHMENT COUPLER FOR HEAVY MACHINERY

(75) Inventors: Jong-Hyuk Lim, Seoul (KR); Jong-Ho Park, Ansan-si (KR); Seong-Tae Jeon, Cheongju-si (KR)

(73) Assignee: Everdignm Corp., Jincheon-eup (KR)

( * ) Notice: Subject to any disclaimer, the term of this patent is extended or adjusted under 35 U.S.C. 154(b) by 0 days.

(21) Appl. No.: 13/331,769

(22) Filed: Dec. 20, 2011

(65) Prior Publication Data

US 2012/0093572 A1 Apr. 19, 2012

Related U.S. Application Data

(63) Continuation of application No. PCT/KR2010/004452, filed on Jul. 8, 2010.

(30) Foreign Application Priority Data

Aug. 12, 2009 (KR) ..... 10-2009-0074443

(51) Int. Cl.
*E02F 3/96* (2006.01)

(52) U.S. Cl.
USPC ..... 403/322.3; 37/468

(58) Field of Classification Search
USPC ..... 403/315–321, 322.3; 37/468
See application file for complete search history.

(56) References Cited

U.S. PATENT DOCUMENTS

| | | | | |
|---|---|---|---|---|
| 5,581,917 | A | 12/1996 | Barden | 37/468 |
| 6,058,633 | A | 5/2000 | Barden | 37/468 |
| 6,902,346 | B2 | 6/2005 | Steig et al. | 403/322.3 |
| 7,493,712 | B2 | 2/2009 | McCormick et al. | 37/468 |
| 7,594,776 | B2 | 9/2009 | Steig et al. | 403/322.3 |
| 7,648,305 | B2 | 1/2010 | Beales | 403/322.1 |
| 7,984,575 | B2 | 7/2011 | Robl et al. | 37/468 |
| 8,177,454 | B2 | 5/2012 | Steig et al. | 403/322.3 |
| 2009/0007465 | A1 | 1/2009 | Robl et al. | |
| 2012/0093572 | A1 | 4/2012 | Lim et al. | 403/31 |

FOREIGN PATENT DOCUMENTS

| | | | |
|---|---|---|---|
| JP | 09-209391 | A | 8/1997 |
| JP | 10-082066 | A | 3/1998 |
| JP | 2000-001872 | A | 1/2000 |

*Primary Examiner* — Victor MacArthur
(74) *Attorney, Agent, or Firm* — NSIP Law

(57) ABSTRACT

An attachment coupler for heavy machinery, which detachably installs an attachment to an arm of the heavy machinery, includes a coupler body coupled to the arm of the heavy machinery, a fixed hook formed on the coupler body and coupled to the attachment via a first coupling pin, a movable hook rotatably coupled to the coupler body via a hinge axis and coupled to the attachment via a second coupling pin, a hydraulic cylinder that rotates the movable hook to be coupled to or disengaged from the second coupling pin, and a locking device that includes a locking hook and an engagement device. The locking hook is rotatably coupled to the coupler body via a hinge axis and closes an open end of the fixed hook while being coupled to the first coupling pin. The engagement device rotates in association with the rotation of the movable hook.

8 Claims, 13 Drawing Sheets

ATTACHMENT COUPLER FOR HEAVY MACHINERY

CROSS REFERENCE TO RELATED APPLICATION(S)

This application is a continuation of International Patent Application No. PCT/KR2010/004452, filed on Jul. 8, 2010, which claims the benefit of Korean Patent Application No. 10-2009-0074443 filed on Aug. 12, 2009, the entire disclosures of which are incorporated herein by reference for all purposes.

TECHNICAL FIELD

The following description relates to an attachment coupler for heavy machinery, and more particularly, to an attachment coupler for heavy machinery which allows an attachment to be replaced according to the purpose of work.

BACKGROUND ART

As typical heavy machinery widely used at construction sites, an excavator is capable of conducting various works using a variety of attachments such as a bucket, a crusher, a breaker, and grab, which can be attached or detached according to the purpose of work. Such an attachment is detachably coupled to an arm of the excavator using a coupler, and thus can be replaced with another type of attachment according to the purpose of work of the excavator.

FIG. 1 is a diagram illustrating an example of a conventional attachment coupler for heavy machinery. Referring to FIG. 1, coupler 10 includes a coupler body 11, a fixed hook 12 installed under the coupler body 11, a movable hook 13 rotatably installed under the coupler body 11, and a hydraulic cylinder 14 for rotating the movable hook 13.

When a cylinder rod 14*a* of the hydraulic cylinder 14 is extended such that a second coupling pin 22 is locked into a coupling groove of the movable hook 13 while a first coupling pin 21 of the attachment 20 is being locked into a coupling groove of the fixed hook 12, the attachment 20 is coupled to an arm 1 of an excavator. When the cylinder rod 14*a* of the hydraulic cylinder 14 is contracted such that the second coupling pin 22 of the attachment is unlocked from the coupling groove of the movable hook 13, the attachment 20 is detached from the arm 1 of the excavator. Accordingly, the attachment 20 can be attached or detached using the coupler 10 installed on the arm 1 of the excavator.

However, in the above conventional coupler 10, if the pressurized oil supplied to the hydraulic cylinder 14 leaks, the cylinder rod 14*a* is broken or the movable hook 13 is damaged, the attachment 20 can be accidently separated from the coupler 10.

In other words, if the pressurized oil supplied to the hydraulic cylinder 14 leaks while the first and second coupling pins 21 and 22 are locked respectively into the fixed hook 12 and the movable hook 13, the cylinder rod 14*a* contracts at a speed corresponding to the amount of leaking oil. Accordingly, as the movable hook 13 of the coupler 10 removes a force restricting the second coupling pin 22 of the attachment 20, the first and the second coupling pins 21 and 22 are respectively unlocked from the fixed hook 12 and the movable hook 13. Hence, the attachment 20 can be separated from the coupler 10.

In the same manner, when the cylinder rod 14*a* breaks, a force restricting the second coupling pin 22 is removed from the movable hook 13 and thus the attachment 20 can be is separated from the coupler 10.

In addition, in the prior art, there is no way of confirming whether the attachment 20 has been completely coupled to the coupler 10. Thus, the attachment 20 may be incompletely coupled to the coupler 10, thereby sometimes being accidently separated from the coupler 10. Moreover, to confirm whether the attachment 20 has been completely coupled to the coupler 10, an operator needs to leave the operating seat and manually check or to ask another operator for help to check.

Technical Problem

The following description relates to an attachment coupler for heavy machinery, which can install an attachment to the heavy machinery more stably while preventing the attachment from being accidently separated.

Technical Solution

The present invention provides an attachment coupler for heavy machinery, which is capable of detachably coupling an attachment to an arm of the heavy machinery, including: a coupler body configured to be coupled to the arm of the heavy machinery; a fixed hook configured to be formed on the coupler body and coupled to the attachment via a first coupling pin of the attachment which is inserted thereinto; a movable hook configured to be rotatably coupled to the coupler body via a hinge axis and coupled to the attachment via a second coupling pin which is inserted thereinto; a hydraulic cylinder configured to rotate the movable hook to be coupled to or disengaged from the second coupling pin; and a locking device configured to comprise a locking hook and an engagement device, wherein the locking hook is configured to be rotatably coupled to the coupler body via a hinge axis and close an open end of the fixed hook while being coupled to the first coupling pin and the engagement device is configured to rotate in association with the rotation of the movable hook to allow the locking hook to be coupled to or disengaged from the first coupling pin in order that the first coupling pin is prevented from being disengaged from the fixed hook while the movable hook stays being coupled to the second coupling pin.

Additional features of the invention will be set forth in the description which follows, and in part will be apparent from the description, or may be learned by practice of the invention.

Advantageous Effects

According to the exemplary embodiments of the present invention, the locking hook and the fixed hook are capable of doubly locking the first coupling pin, and thus the attachment can be more stably coupled to the coupler.

In addition, if the pressurized oil supplied to the hydraulic cylinder leaks, the cylinder rod of the hydraulic cylinder is broken or the movable hook is damaged while the attachment is being installed to an arm of heavy machinery using the coupler, the attachment can be prevented from being accidently separated from the coupler.

Moreover, it is possible for the operator to conveniently check at the operating seat whether the attachment has been completely coupled to the coupler. Furthermore, it is possible to prevent the occurrence of separation of the attachment from the coupler due to the incomplete coupling between the attachment and the coupler.

DESCRIPTION OF DRAWINGS

The accompanying drawings, which are included to provide a further understanding of the invention and are incorporated in and constitute a part of this specification, illustrate embodiments of the invention, and together with the description serve to explain the principles of the invention.

Mode for Invention

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 1:
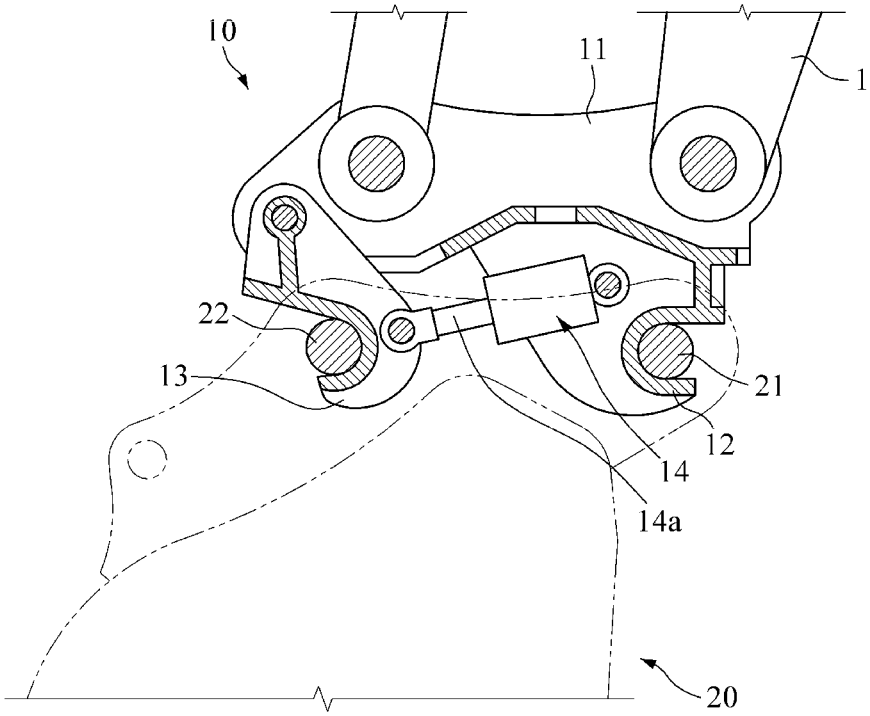
FIG. 1 PRIOR ART
FIG. 1 is a diagram illustrating a cross-sectional view of an example of a conventional attachment coupler for heavy machinery.
Figure 2:
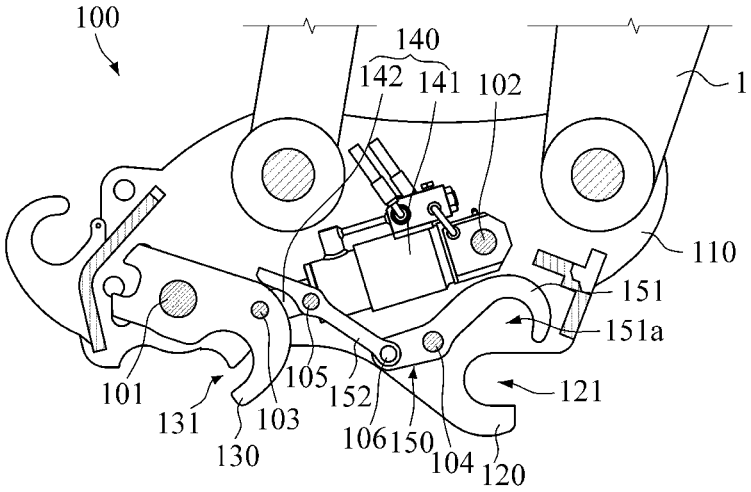
FIG. 2 is a diagram illustrating a cross-sectional view of an example of an attachment coupler for heavy machinery.
Figure 3:
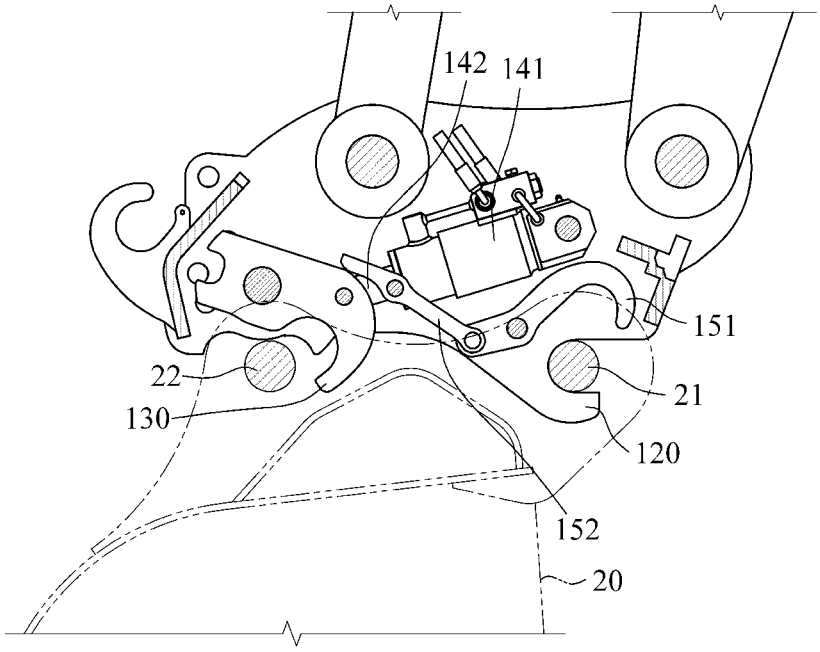
FIGS. 3 and 4 are diagrams illustrating cross-sectional views of an example of the attachment coupler shown in FIG. 2 before and after an attachment are installed thereto.
Figure 4:
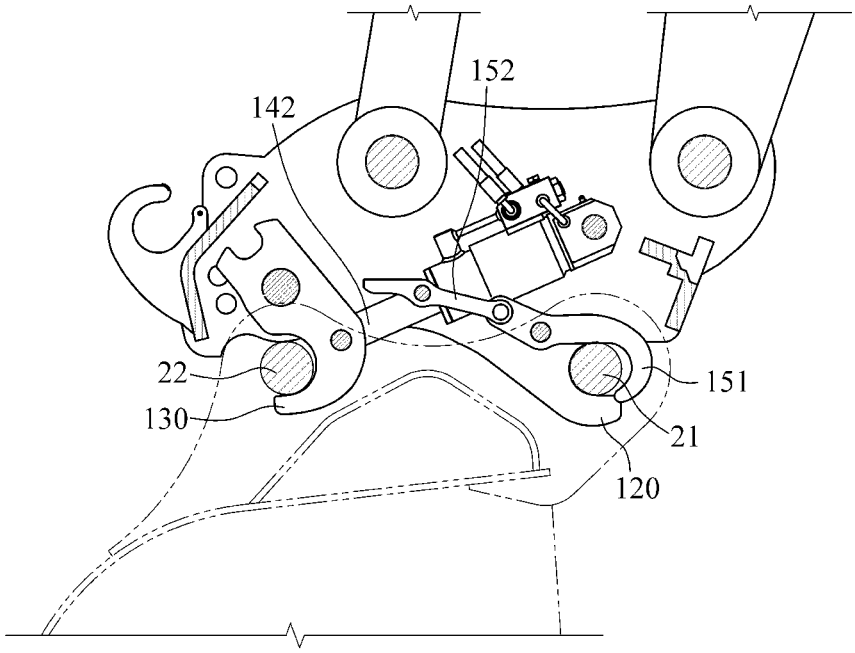

FIG. 2 is a diagram illustrating a cross-sectional view of an example of an attachment coupler for heavy machinery. FIG. 3 is a diagram illustrating a cross-sectional view of an example of the attachment coupler shown in FIG. 2 before an attachment is installed thereto. FIG. 4 is a diagram illustrating a cross-sectional view of an example of the attachment coupler shown in FIG. 2 after the attachment has been installed thereto.

Referring to FIGS. 2 to 4, attachment coupler 100 for heavy machinery is for use in detachably installing an attachment 20 to an arm 1 of the heavy machinery, for example, an excavator. The attachment 20 may be a bucket, a crusher, a breaker, or a grab.

The coupler 100 may include a coupler body 110, a fixed hook 120, a movable hook 130, a hydraulic cylinder 140, and a locking device 150. The coupler body 110 is coupled to the arm 1 of the heavy machinery. The coupler body 110 may be coupled to the arm 1 of the heavy machinery using a plurality of fixed pins. The coupler body 110 may have an inner space and a lower portion configured to be open.

The fixed hook 120 may be integrally formed with the coupler body 110. The fixed hook 120 may be configured to allow a first coupling pin 21 of the attachment 20 to be locked thereinto. For example, the fixed hook 120 may have a coupling groove 121 formed thereon. The coupling groove 121 has an opening in an outside direction. The first coupling pin 21 may be coupled to or disengaged from the fixed hook 120 while moving in and out of the coupling groove 121.

The movable hook 130 may be coupled to the coupler body 110 via a hinge axis 101, thereby enabling to rotate. The movable hook 130 is coupled to the attachment 20 via the second coupling pin 22 of the attachment 20 which is inserted thereinto. For example, the movable hook 130 may be rotatably positioned above the second coupling pin 22 and include a coupling groove 131 with an open end. The second coupling pin 22 may be coupled to or disengaged from the movable hook 130 while moving in and out of the coupling groove 131 according to the rotation direction of the movable hook 130.

The hydraulic cylinder 140 may be used for rotating the movable hook 130 such that the movable hook 130 is coupled with or disengaged from the second coupling pin 22. The hydraulic cylinder 140 may include a cylinder body 141 and a cylinder rod 142 which is extended or contracted with respect to the cylinder body 141 as pressured oil is supplied thereinto or discharged therefrom.

The cylinder body 141 may be coupled to the coupler body 110 via the hinge axis 102, and the cylinder rod 142 may be coupled to the movable hook 130 via a hinge axis 103. As the cylinder rod 142 extracts or contracts, the movable hook 130 rotates to be close to or away from the second coupling pin 22, thereby enabling to be coupled to or disengaged from the second coupling pin 22.

In addition, if the cylinder rod 142 remains in an extended state once the movable hook 130 is coupled to the second coupling pin 22 while the fixed hook 120 is coupled to the first coupling pin 21, the attachment 20 can remain locked onto the coupler 100.

The locking device 150 may prevent the first coupling pin 21 from being disengaged from the fixed hook 120 while the movable hook 130 is coupled to the second coupling pin 22. The locking device 150 may include a locking hook 151 and an engagement device.

The locking hook 151 may be coupled to the coupler body 110 via a hinge axis 104, which allows the rotation. In this case, the locking hook 151 may be coupled to the coupler body 110 via the hinge axis 104 such that the locking hook 151 can rotate by its own weight in a direction of being able to be coupled to the first coupling pin 21.

The locking hook 151 is formed to close the open end of the fixed hook 120 when being coupled to the first coupling pin 21. For example, the locking hook 151 may be rotatably positioned above the first coupling pin 21, and have a coupling groove 151*a* with an open end. In addition, the coupling groove 151*a* of the locking hook 151 is formed to face the open end of the fixed hook 120 when the locking hook 151 is being coupled to the first coupling pin 21, and thus can close the open end of the fixed hook 120.

The engagement device is engaged with the movable hook 130 according to the rotation of the movable hook 130, and allows the locking hook 151 to be coupled to or separated from the first coupling pin 21. That is, the engagement device rotates the locking hook 151 to be coupled to the first coupling pin 21 as the movable hook 130 rotates to be coupled to the second coupling pin 22. In addition, the engagement device rotates the locking hook 151 to be disengaged from the first coupling pin 21 as the movable hook 130 rotates to be disengaged from the second coupling pin 22. Accordingly, when the movable hook 130 is disengaged from the second coupling pin 22, the locking hook 151 is simultaneously disengaged from the first coupling pin 21, and thereby the attachment 20 is allowed to be separated from the coupler 100. Moreover, when the movable hook 130 is coupled to the second coupling pin 22, the locking hook 151, as well as the fixed hook 120, is coupled to the first coupling pin 21, and thereby the attachment 20 is allowed to be installed onto the coupler 100.

As described above, the locking device 150 equipped to the coupler 100 enables to doubly restrict the first coupling pin 21 with the locking hook 151 and the fixed hook 120, and thus the attachment 20 can be more safely coupled to the coupler 100.

In addition, even when the second coupling pin 22 is disengaged from the movable hook 130 due to the contraction of the cylinder rod 142 which is caused by the leakage of pressurized oil supplied to the hydraulic cylinder 140 while the heavy machinery is working with the attachment 20 installed on its arm 1, the locking hook 151 may still close the open end of the fixed hook 120. Hence, the accidental separation of the attachment 20 from the coupler 100 due to the disengagement of the first coupling pin 21 from the fixed hook 120 can be prevented.

Moreover, even when the second coupling pin 22 is disengaged from the movable hook 130 due to the break of the cylinder rod 142 or damage to the movable hook 130, the locking hook 151 may still close the open end of the fixed hook 120, and thus the accidental separation of the attachment 20 from the coupler 100 can be prevented.

In one example, the engagement device may include a link member 152. The link member 152 may be disposed between the locking hook 151 and the movable hook 130 and coupled to the coupler body 110 via a hinge axis 105. The hinge axis 105 may be installed on the coupler body 110 in a manner that does not interfere with the extending and contracting motion of the cylinder rod 142. The link member 152 has an end facing the movable hook 130 and the other end coupled to the locking hook 151 via a hinge axis 106.

Accordingly, when the movable hook 130 rotates in a direction of being able to be disengaged from the second coupling pin 22, the movable hook 130 pushes one end of the link member 152, and consequently the link member 152 is rotated and allows the locking hook 151 to be disengaged from the first coupling pin 21. In addition, as the movable hook 130 rotates in a direction of being able to be coupled to the second coupling pin 22, one end of the link member 152 moves away from the movable hook 130 and thereby allows the locking hook 151 to rotate by its own weight and thus be coupled to the first coupling pin 21.

Figure 5:
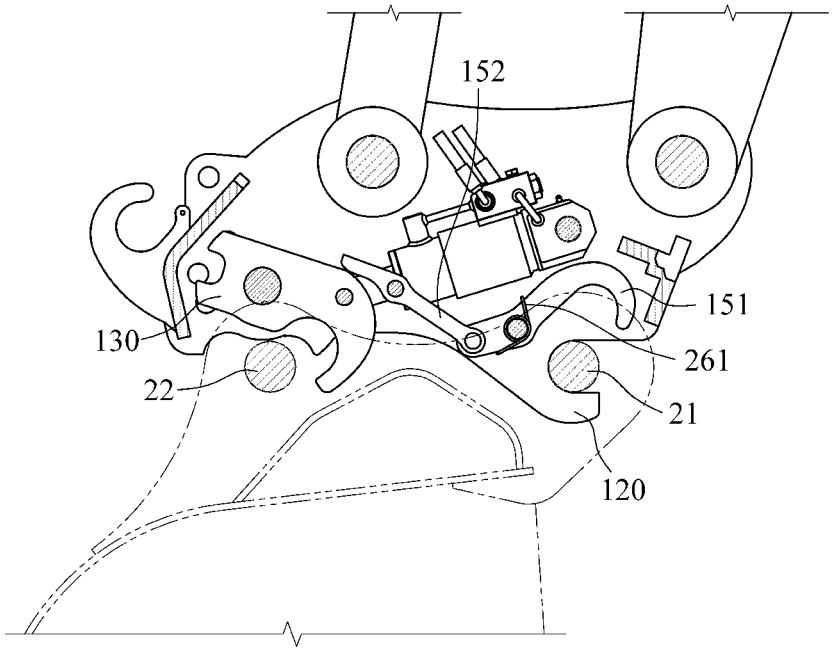
FIGS. 5 to 7 are diagrams illustrating cross-sectional views of an example of the attachment coupler shown in FIG. 3 which includes an elastic member.

As shown in FIG. 5, as one end of the link member 152 moves away from the movable hook 130, the locking hook 151 may be rotated not only by its own weight but also by an elastic member, for example, a torsion spring 261 and thus be coupled to the first coupling pin 21. The torsion spring 261 may provide an elastic force to allow the locking hook 151 to rotate in a direction of being able to be coupled to the first coupling pin 21.

That is, when the movable hook 130 rotates in a direction of being disengaged from the second coupling pin 22 and thereby one end of the link member 152 moves back by the movable hook 130 and thus is rotated, the torsion spring 261 is elastically deformed. Thereafter, when the movable hook 130 rotates in a direction of being coupled to the second coupling pin 22 and thereby a force applied to the one end of the link member 152 is removed, the locking hook 151 is rotated by a restoration force of the torsion spring 261 in a direction of being able to be coupled to the first coupling pin 21. Accordingly, the locking hook 151 is allowed to be coupled to the first coupling pin 21.

Figure 6:
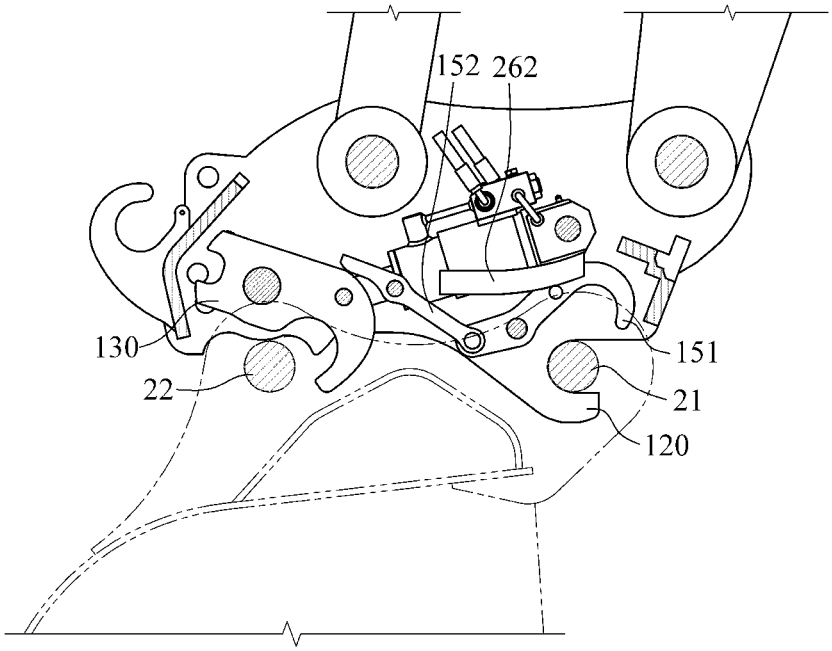
Figure 7:
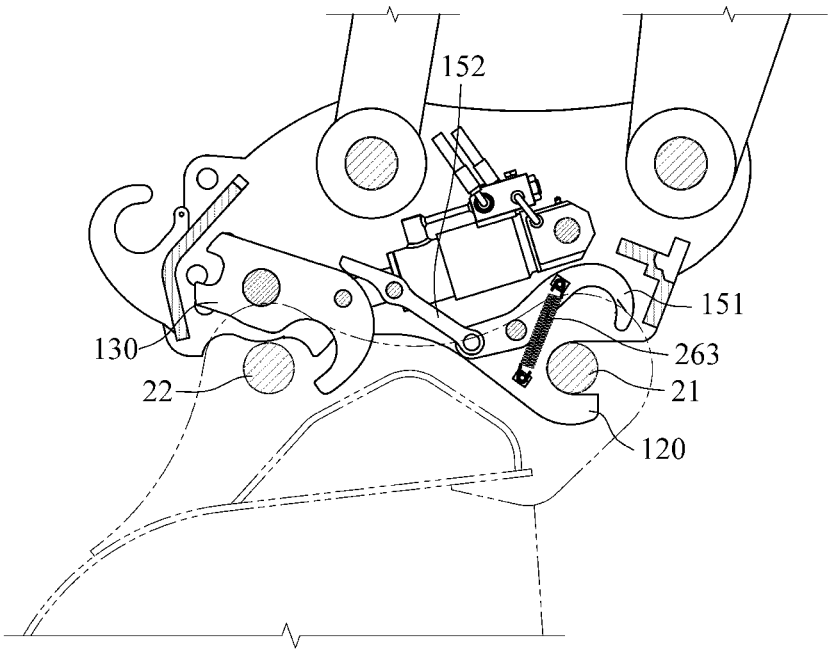

As another example of an elastic member, as shown in FIG. 6, a leaf spring 262 may be used, or, as shown in FIG. 7, a coil spring 263 may be used. Both the leaf spring 262 and the coil spring 263 may be installed to apply an elastic force to the locking hook 151 in a direction allowing the locking hook 151 to be coupled to the first coupling pin 21.

Figure 8:
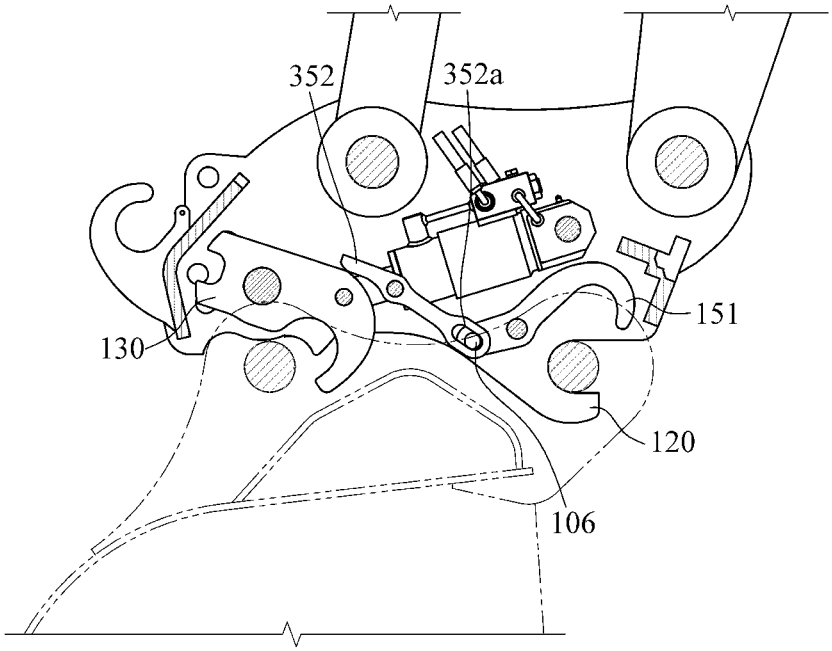
FIG. 8 is a diagram illustrating a cross-sectional view of an example of the attachment coupler shown in FIG. 3 which includes a link member having a slot hole.

As shown in FIG. 8, a link member 352 may include a slot hole 352*a* formed on a region to which the locking hook 151 is coupled via a hinge axis 106, and the hinge axis 106 is formed to slide along the slot hole 352*a*. The slot hole 352*a* may be formed along a longitudinal direction of the link member 352.

Accordingly, the locking hook 151 may be prevented from being disengaged from the first coupling pin 21 until the movable hook 130 is disengaged from the second coupling pin 22 as the hinge axis 106 slides along the slot hole 352*a*, and thus the coupling between the locking hook 151 and the first coupling pin 21 can be more stably maintained.

Figure 9:
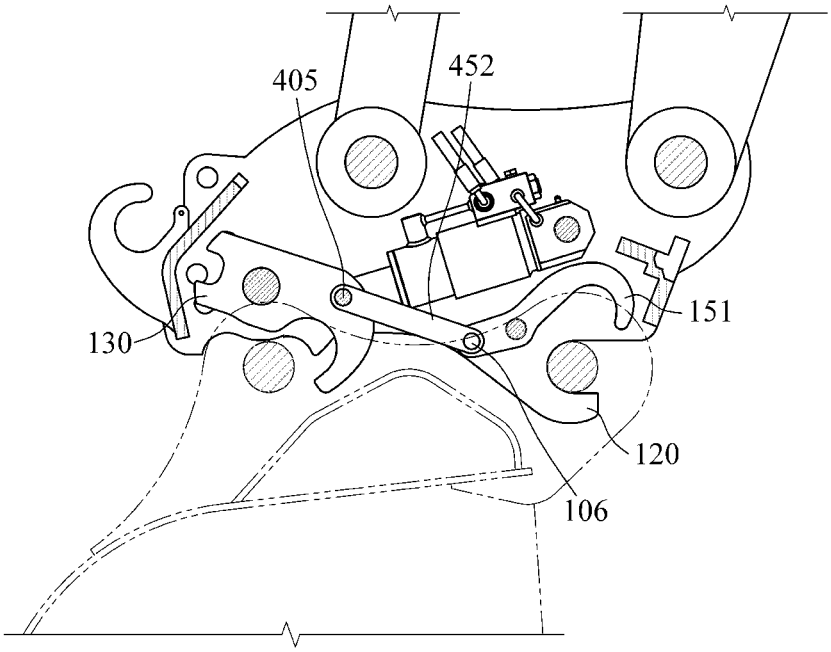
FIG. 9 is a diagram illustrating a cross-sectional view of an example of the attachment coupler shown in FIG. 3 which includes a modified link member.

As another example, as shown in FIG. 9, a link member 452 may have one end being coupled to the movable hook 130 via a hinge axis 405 and the other end being coupled to the locking hook 151 via a hinge axis 106. Accordingly, the link member 452 may be allowed to rotate along with the movable hook 130. Thus, as the movable hook 130 rotates in a direction of being coupled to the second coupling pin 22, the link member 452 may rotate the locking hook 151 in a direction allowing the locking hook 151 to be coupled to the first coupling pin 21. In addition, as the movable hook 130 rotates in a direction of being disengaged from the second coupling pin 22, the link member 452 may rotate the locking hook 151 in a direction allowing the locking hook 151 to be disengaged from the first coupling pin 21.

Figure 10:
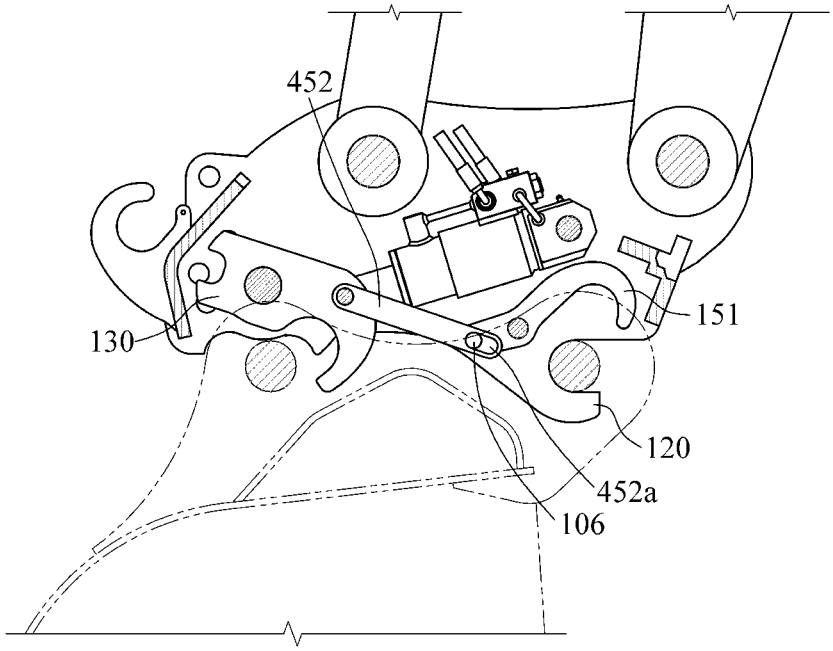
FIG. 10 is a diagram illustrating a cross-section view of an example of the attachment coupler shown in FIG. 9 which includes a link member having a slot hole.

In this case, the link member 452, as shown in FIG. 10, may include a slot hole 452*a* formed on a region to which the locking hook 151 is coupled via a hinge axis 106, and the hinge axis 106 may be formed to slide along the slot hole 452*a*. The slot hole 452*a* may contribute to stabilizing the coupling between the locking hook 151 and the first coupling pin 21 as shown in the example illustrated in FIG. 8.

Figure 11:
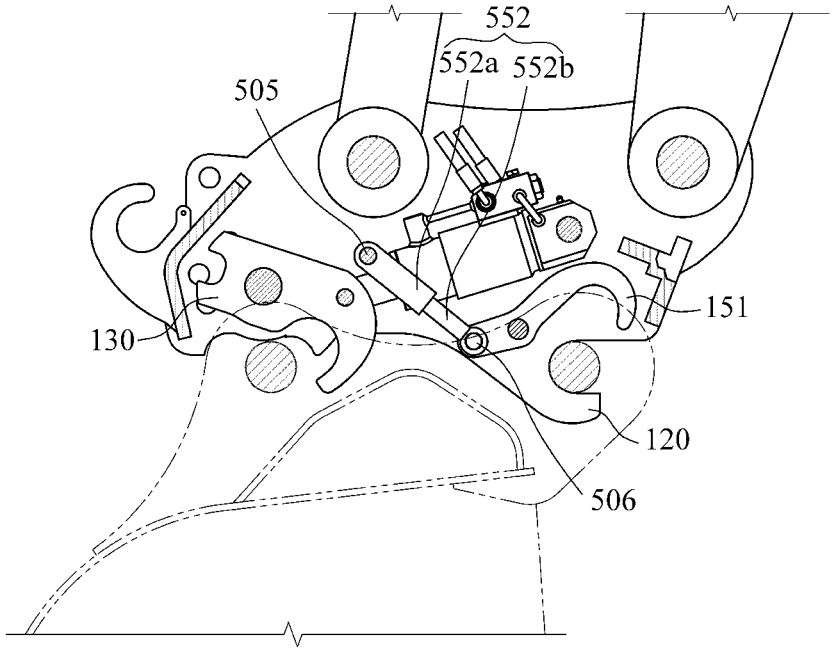
FIGS. 11 to 13 are diagrams illustrating cross-sectional views of an example of the attachment coupler shown in FIG. 3 which includes a modified engagement device.

As another example, as shown in FIG. 11, the engagement device may include a locking cylinder 552. The locking cylinder 552 may include a cylinder body 552*a* and a cylinder rod 552*b* that extends or contracts by oil pressure or air pressure with respect to the cylinder body 552*a*. The cylinder body 552*a* may be coupled to the coupler body 110 via a hinge axis 505, and the cylinder rod 552*b* may be coupled to the locking hook 151 via a hinge axis 506.

Figure 12:
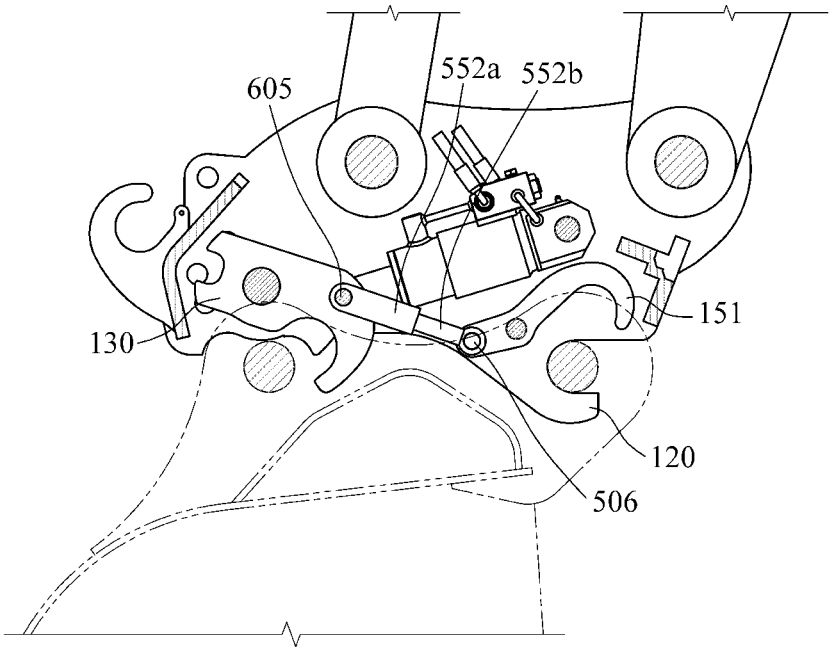

Accordingly, as the movable hook 130 rotates in a direction of being coupled to or disengaged from the second coupling pin 22, the cylinder rod 552*b* which is engaged with the movable hook 130 extends or contracts, so that the locking hook 151 can be coupled to or disengaged from the first coupling pin 21. As another example, as shown in FIG. 12, the cylinder body 552*a* may be coupled to the movable hook 130 via the hinge axis 605.

Figure 13:
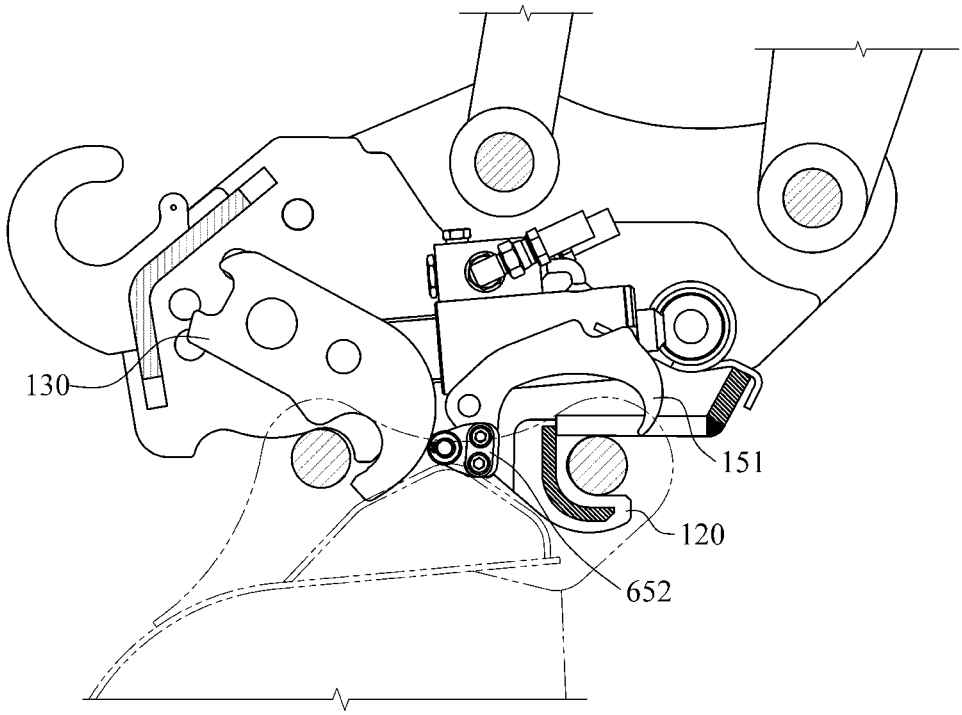

As another example, as shown in FIG. 13, the engagement device may include a rotating body 652. The rotating body 652 may be included in the locking hook 151 and as the movable hook 130 pushes the rotating body 652 without using the engagement device while being rotated, the rotating body 652 allows the locking hook 151 to be coupled to or disengaged from the first coupling pin 21.

The locking hook 151 may be formed to protrude from the coupler body 110 while being coupled to the first coupling pin 21. As a result, the operator enables to directly determine whether the first coupling pin 21 is completely coupled to the fixed hook 120, and indirectly determine whether the second coupling pin 22 is completely coupled to the movable hook 130. Thus, it is possible to conveniently check whether the attachment 20 has been completely coupled to the coupler 100. In addition, separation of the attachment 20 from the coupler 100 can be prevented from occurring.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

The invention claimed is:

1. An attachment coupler for heavy machinery, which is capable of detachably coupling an attachment to an arm of the heavy machinery, comprising:

a coupler body configured to be coupled to the arm of the heavy machinery;

a fixed hook configured to be formed on the coupler body and coupled to the attachment via a first coupling pin of the attachment which is inserted thereinto;

a movable hook configured to be rotatably coupled to the coupler body via a hinge axis and coupled to the attachment via a second coupling pin which is inserted thereinto;

a hydraulic cylinder configured to rotate the movable hook to be coupled to or disengaged from the second coupling pin; and a locking device configured to comprise a locking hook and an engagement device, wherein the locking hook is configured to be rotatably coupled to the coupler body via a hinge axis and close an open end of the fixed hook while being coupled to the first coupling pin; the engagement device is configured to physically contact the movable hook so that the rotation of the movable hook rotates the engagement device, the rotation of the engagement device causing the locking hook to be coupled to or disengaged from the first coupling pin; and the engagement device is configured to prevent the locking hook from disengaging the first coupling pin while the movable hook is coupled to the second coupling pin.

2. The attachment coupler of claim 1, wherein the locking hook is configured to protrude from the coupler body while being coupled to the first coupling pin such that an operator can determine at an operating seat whether the first coupling pin and the second coupling pin have been completely coupled to the fixed hook and the movable hook, respectively.

3. The attachment coupler of claim 1, wherein the engagement device comprises a link member, and the link member includes a slot hole formed on a region to which the locking hook is coupled via the hinge axis and the hinge axis slides along the slot hole.

4. The attachment coupler of claim 1, wherein the engagement device comprises a link member, and the rotation of the movable hook pushes an end portion of the link member, causing the link member to rotate.

5. An attachment coupler for heavy machinery, which is capable of detachably coupling an attachment to an arm of the heavy machinery, comprising:

a coupler body configured to be coupled to the arm of the heavy machinery;

a fixed hook configured to be formed on the coupler body and coupled to the attachment via a first coupling pin of the attachment which is inserted thereinto;

a movable hook configured to be rotatably coupled to the coupler body via a hinge axis and coupled to the attachment via a second coupling pin which is inserted thereinto;

a hydraulic cylinder configured to rotate the movable hook to be coupled to or disengaged from the second coupling pin; and a locking device configured to comprise a locking hook and an engagement device, wherein the locking hook is configured to be rotatably coupled to the coupler body via a hinge axis and close an open end of the fixed hook while being coupled to the first coupling pin;

the engagement device is configured to rotate in association with the rotation of the movable hook to allow the locking hook to be coupled to or disengaged from the first coupling pin; and the engagement device is configured to prevent the locking hook from disengaging the first coupling pin while the movable hook is coupled to the second coupling pin; and wherein the engagement device comprises a link member, the link member comprises one end being coupled to the movable hook via a hinge axis and the other end being coupled to the locking hook via a hinge axis, and as the movable hook rotates in a direction of being coupled to the second coupling pin, the link member allows the locking hook to be coupled to the first coupling pin.

6. The attachment coupler of claim 5, wherein the link member includes a slot hole formed on a region to which the locking hook is coupled via the hinge axis and the hinge axis slides along the slot hole.

7. The attachment coupler of claim 5, wherein the locking hook is configured to protrude from the coupler body while being coupled to the first coupling pin such that an operator can determine at an operating seat whether the first coupling pin and the second coupling pin have been completely coupled to the fixed hook and the movable hook, respectively.

8. The attachment coupler of claim 5, wherein the rotation of the movable hook pushes an end portion of the link member, causing the link member to rotate.

* * * * *